US005941315A

United States Patent [19]

Lai et al.

[11] Patent Number: 5,941,315

[45] Date of Patent: Aug. 24, 1999

[54] AUTOMOBILE ENGINE FIRE EXTINGUISHING SYSTEM

[76] Inventors: Taming Lai; Roberto Calvera, both of 1801 W. La Habra Blvd., La Habra, Calif. 90631

[21] Appl. No.: 08/971,556

[22] Filed: Nov. 17, 1997

[51] Int. Cl.[6] ..... A62C 3/07

[52] U.S. Cl. ..... 169/62; 169/54

[58] Field of Search ..... 169/54, 62

[56] References Cited

U.S. PATENT DOCUMENTS

| | | | |
|---|---|---|---|
| 3,387,662 | 6/1968 | Molgano, Jr. | 169/62 X |
| 3,515,218 | 6/1970 | Gardner et al. | 169/62 X |
| 4,025,101 | 5/1977 | Hensel, Jr. | 169/62 X |
| 4,265,316 | 5/1981 | Fee | 169/19 |
| 4,423,784 | 1/1984 | Bolen | 169/62 |
| 4,982,798 | 1/1991 | Wang | 169/62 |
| 4,986,365 | 1/1991 | Shieh | 169/62 X |
| 5,613,564 | 3/1997 | Rhines | 169/62 X |

*Primary Examiner*—Andres Kashnikow
*Assistant Examiner*—Robin O. Evans

[57] ABSTRACT

An automobile engine fire extinguishing system including an extinguisher canister secured within an automobile adjacent to its engine. The extinguisher holds fire retardant material therein. The extinguisher canister has an outlet valve for dispensing the fire retardant material out of the canister. The outlet valve has a lever coupled thereto for releasing the fire retardant material into the engine. A release handle is positioned within an interior of the automobile adjacent to a steering wheel thereof. The release handle has a shaft extending inwardly therefrom and is secured to the lever for releasing thereof.

1 Claim, 2 Drawing Sheets

AUTOMOBILE ENGINE FIRE EXTINGUISHING SYSTEM

BACKGROUND OF THE INVENTION

1. Field of the Invention

The present invention relates to an automobile engine fire extinguishing system and more particularly pertains to extinguishing a fire in an engine without having to leave an automobile with an automobile engine fire extinguishing system.

2. Description of the Prior Art

The use of fire extinguisher systems is known in the prior art. More specifically, fire extinguisher systems heretofore devised and utilized for the purpose of extinguishing fires are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,986,365 to Shieh; U.S. Pat. No. 4,982,798 to Wang; U.S. Pat. No. 4,423,784 to Bolen; U.S. Pat. No. 4,338,896 to Papasideris; U.S. Pat. No. 4,265,316 to Fee; and U.S. Pat. No. 307,648 to Arrington.

While these devices fulfill their respective, particular objective and requirements, the aforementioned patents do not describe an automobile engine fire extinguishing system for extinguishing a fire in an engine without having to leave an automobile.

In this respect, the automobile engine fire extinguishing system according to the present invention substantially departs from the conventional concepts and designs of the prior art, and in doing so provides an apparatus primarily developed for the purpose of extinguishing a fire in an engine without having to leave an automobile.

Therefore, it can be appreciated that there exists a continuing need for new and improved automobile engine fire extinguishing system which can be used for extinguishing a fire in an engine without having to leave an automobile. In this regard, the present invention substantially fulfills this need.

SUMMARY OF THE INVENTION

In the view of the foregoing disadvantages inherent in the known types of fire extinguisher systems now present in the prior art, the present invention provides an improved automobile engine fire extinguishing system. As such, the general purpose of the present invention, which will be described subsequently in greater detail, is to provide a new and improved automobile engine fire extinguishing system and method which has all the advantages of the prior art and none of the disadvantages.

To attain this, the present invention essentially comprises a length of metal tubing secured to an underside of a hood of an automobile. The metal tubing extends around a periphery of the hood. The metal tubing has a series of outlet apertures in a spaced relationship. An extinguisher canister is secured within the automobile adjacent to the engine. The extinguisher holds fire retardant material therein. The extinguisher canister has an outlet valve for dispensing the fire retardant material out of the canister. The outlet valve couples with a manifold. The manifold has a bifurcated outlet. The bifurcated outlet couples with the length of metal tubing. The outlet valve has a lever coupled thereto for releasing the fire retardant material into the manifold and into the length of metal tubing. A release handle is positioned within an interior of the automobile adjacent to a steering wheel thereof. The release handle has a shaft extending inwardly therefrom and secured to the lever for releasing thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automobile engine fire extinguishing system which has all the advantages of the prior art fire extinguisher systems and none of the disadvantages.

It is another object of the present invention to provide a new and improved automobile engine fire extinguishing system which may be easily and efficiently manufactured and marketed.

It is a further object of the present invention to provide a new and improved automobile engine fire extinguishing system which is of durable and reliable construction.

An even further object of the present invention is to provide a new and improved automobile engine fire extinguishing system which is susceptible of a low cost of manufacture with regard to both materials and labor, and which accordingly is then susceptible of low prices of sale to the consuming public, thereby making such an automobile engine fire extinguishing system economically available to the buying public.

Even still another object of the present invention is to provide a new and improved automobile engine fire extinguishing system for extinguishing a fire in an engine without having to leave an automobile.

Lastly, it is an object of the present invention to provide a new and improved automobile engine fire extinguishing system including an extinguisher canister secured within an automobile adjacent to its engine. The extinguisher holds fire retardant material therein. The extinguisher canister has an outlet valve for dispensing the fire retardant material out of the canister. The outlet valve has a lever coupled thereto for releasing the fire retardant material into the engine. A release handle is positioned within an interior of the automobile adjacent to a steering wheel thereof. The release handle has a shaft extending inwardly therefrom and is secured to the lever for releasing thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
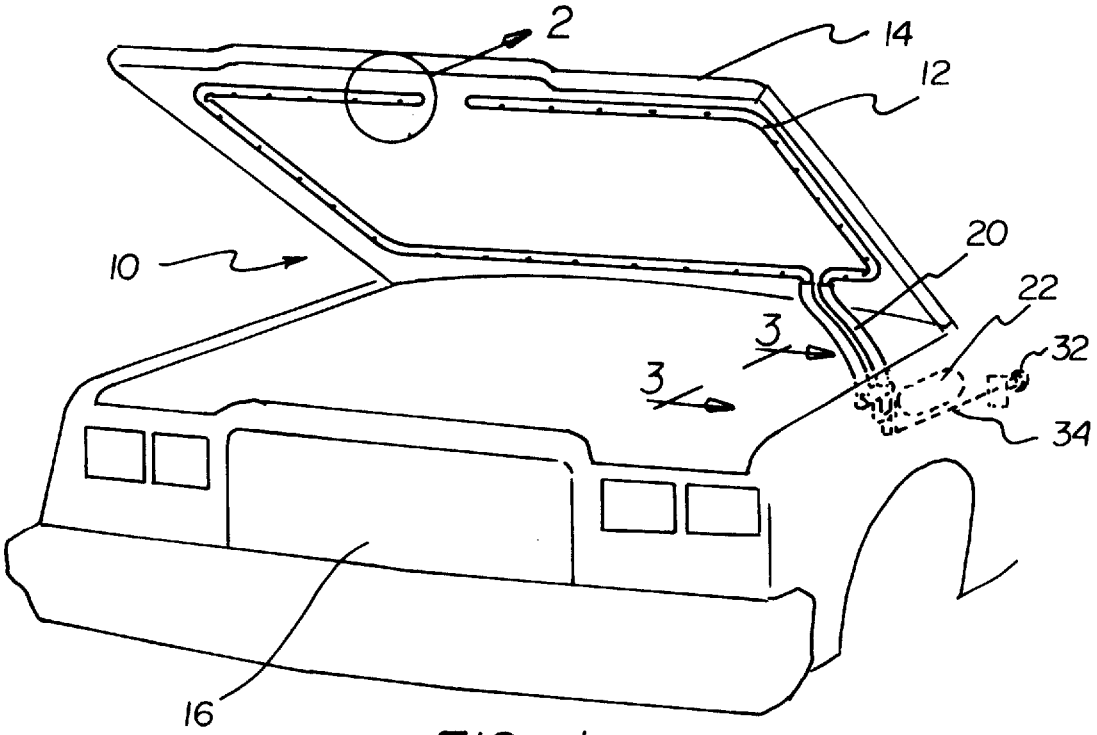
FIG. 1 is a perspective view of the preferred embodiment of the automobile engine fire extinguishing system constructed in accordance with the principles of the present invention.
Figure 2:
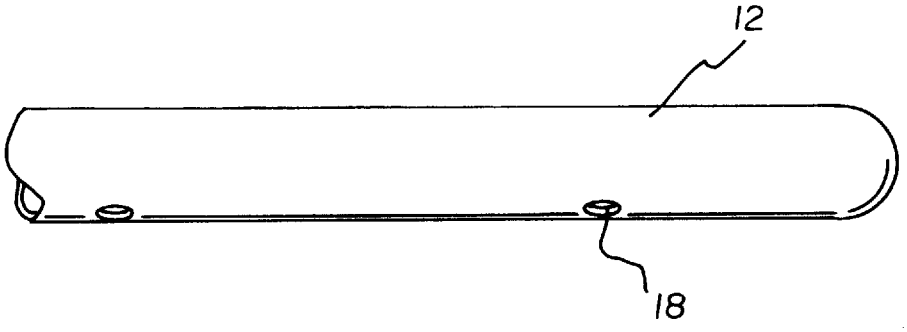
FIG. 2 sectional view of the metal tubing as taken from circle 2 of FIG. 1.
Figure 3:
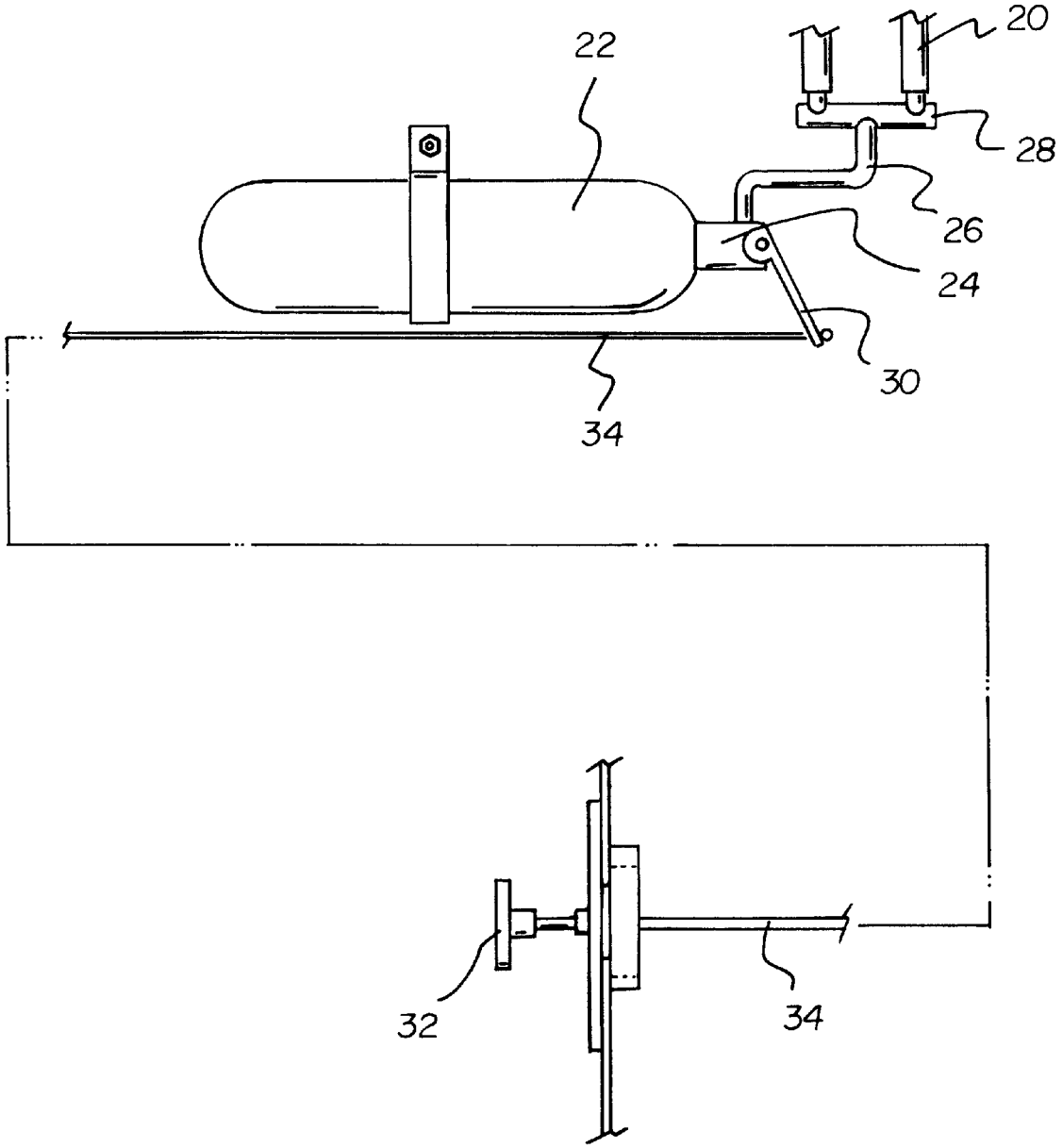
FIG. 3 is side view of the extinguisher canister, manifold and release knob of the present invention as taken along line 3—3 of FIG. 1.

With reference now to the drawings, and in particular, to FIGS. 1 through 3 thereof, the preferred embodiment of the new and improved automobile engine fire extinguishing system embodying the principles and concepts of the present invention and generally designated by the reference number 10 will be described.

Specifically, it will be noted in the various Figures that the device relates to an automobile engine fire extinguishing system for extinguishing a fire in an engine without having to leave an automobile. In its broadest context, the device consists of a length of metal tubing, an extinguisher canister and a release handle. Such components are individually configured and correlated with respect to each other so as to attain the desired objective.

The length of metal tubing 12 is secured to an underside of a hood 14 of an automobile 16. The metal tubing 12 extends around a periphery of the hood 14. The metal tubing 12 has a series of outlet apertures 18 in a spaced relationship. The metal tubing 12, as viewed in FIGS. 1 and 2, includes a pair of lengths of tubing 12 that are secured to the underside of the hood 14 by brackets. Free ends 20 of the tubing 12 extend downwardly from the hood 16 and enter into the engine cavity to a position adjacent to the extinguisher canister 22.

The extinguisher canister 22 is secured within the automobile adjacent to the engine. The extinguisher canister 22 holds fire retardant material therein. The extinguisher canister 22 has an outlet valve 24 for dispensing the fire retardant material out of the canister 22. The outlet valve 24 couples with a manifold 26. The manifold 26 has a bifurcated outlet 28. The bifurcated outlet 28 couples with the free ends 20 of the lengths of metal tubing 12. The outlet valve 24 has a lever 30 coupled thereto for releasing the fire retardant material into the manifold 26 and into the length of metal tubing 12.

The release handle 32 is positioned within an interior of the automobile 16 adjacent to a steering wheel thereof. The release handle 32 has a shaft 34 extending inwardly therefrom and secured to the lever 30 for releasing thereof.

In use, when a driver of the automobile 16 notices smoke or fire within the engine, he/she simply grasps the release handle 32 and pulls the release handle 32 towards them. This will pull forward on the lever 30 which will cause the outlet valve 24 to release the fire retardant material into the manifold 26 which will facilitate the fire retardant material transport into the length of tubing where it will dispense through the outlet apertures 18 to extinguish the fire.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An automobile engine fire extinguishing system for extinguishing a fire in an engine without having to leave an automobile comprising, in combination:

a length of metal tubing secured to an underside of a hood of an automobile, the metal tubing extending around a periphery of the hood, including the front and back and two sides, the metal tubing having a series of outlet apertures in a spaced relationship;

an extinguisher canister secured within the automobile adjacent to the engine, the extinguisher holding fire retardant material therein, the extinguisher canister having an outlet valve for dispensing the fire retardant material out of the canister, the outlet valve coupling with a manifold, the manifold having a bifurcated outlet, the bifurcated outlet coupling with the length of metal tubing, the outlet valve having a lever coupled thereto for releasing the fire retardant material into the manifold and into the length of metal tubing to dispense the fire retardant material onto the front and back and two sides of the engine; and a release handle positioned within an interior of the automobile adjacent to a steering wheel thereof, the release handle having a shaft extending inwardly therefrom and secured to the lever for releasing thereof.

* * * * *